US009052141B2

(12) United States Patent
Andrisin, III et al.

(10) Patent No.: US 9,052,141 B2
(45) Date of Patent: Jun. 9, 2015

(54) WET FLOOR WARNING DEVICE WITH FLOOR DRYER

(76) Inventors: John J. Andrisin, III, Brunswick, OH (US); Benjamin A. Scholles, Hartville, OH (US); Wesley A. Schroeder, Seville, OH (US)

( * ) Notice: Subject to any disclaimer, the term of this patent is extended or adjusted under 35 U.S.C. 154(b) by 1938 days.

(21) Appl. No.: 11/331,373

(22) Filed: Jan. 12, 2006

(65) Prior Publication Data

US 2007/0157485 A1 Jul. 12, 2007

(51) Int. Cl.
*F26B 11/02* (2006.01)
*F26B 21/00* (2006.01)

(52) U.S. Cl.
CPC ..... *F26B 21/001* (2013.01)

(58) Field of Classification Search
CPC ..... F26B 3/00; F26B 5/00; F26B 11/00; F26B 11/02; A46B 13/00; A46B 13/02
USPC ..... 34/201, 90, 105; 15/209.1, 244.1
See application file for complete search history.

(56) References Cited

U.S. PATENT DOCUMENTS

| | | | | |
|---|---|---|---|---|
| 3,286,368 | A * | 11/1966 | Thomas | 34/618 |
| D328,615 | S | 8/1992 | Taylor | D20/19 |
| 5,208,940 | A | 5/1993 | London et al. | 15/345 |
| 5,797,197 | A | 8/1998 | Alday | 34/618 |
| 6,202,322 | B1 | 3/2001 | Turner | 34/618 |
| 6,615,508 | B1 | 9/2003 | Valle | 34/201 |
| 6,739,070 | B1 | 5/2004 | Jacobs et al. | 34/90 |
| 7,007,403 | B1 | 3/2006 | Studebaker | |
| 7,201,563 | B2 | 4/2007 | Studebaker | |
| 2003/0115783 | A1 | 6/2003 | Woosley | 40/584 |
| 2005/0144801 | A1 | 7/2005 | Wilson | 34/60 |
| 2006/0067818 | A1 | 3/2006 | Studebaker | |
| 2006/0143936 | A1 | 7/2006 | Studebaker | |

OTHER PUBLICATIONS

Dri-Eaz ACE TurboDryer, presented in a print out of www.jondon.com/ace/ on Apr. 3, 2006 (2 pages).
Eagle Safe-T-Buoy, http://ivie-ent.com/machines/details.asp?EquipID=safetbuoy printed Apr. 3, 2006 (1 page).
Powr-flite Whole Room Drier [PDF6WRD], www.steam-brite.com/store/product_info.php/products_id/4386 printed Apr. 3, 2006 (2 pages).

* cited by examiner

*Primary Examiner* — Stephen Gravini
(74) *Attorney, Agent, or Firm* — John D Gugliotta

(57) ABSTRACT

A warning device of the type that is typically employed to warn pedestrians of a wet floor operates a floor dryer into its design so that, in addition to warning pedestrians of the wet floor, the device may be employed to dry the floor. An air director element produces a beneficial air flow providing increased drying efficacy.

7 Claims, 6 Drawing Sheets

WET FLOOR WARNING DEVICE WITH FLOOR DRYER

TECHNICAL FIELD

The present invention generally relates to wet floor warning devices, and, more particularly, relates to warning devices having means for drying the wet floors on which they are placed to warn pedestrians of the potential hazard.

BACKGROUND ART

Slippery floors are potential disasters for unaware pedestrians. Every year, slip and fall accidents result in thousands of disabling injuries, and these accidents often bring about lawsuits. Safety cones, floor signs and barricades are widely used in all types of retail stores, restaurants, gas stations, hospitals, schools, etc., to warn pedestrians of the danger of slipping or falling. Typically, these devices are brightly colored to alert people. They usually have cautionary statements printed on them, advising pedestrians of a possible danger.

Although most establishments dutifully mop up wet floor areas, mopping usually does not sufficiently dry the area, especially when there is continual foot traffic that may bring in rain or snow from the outdoors. Marking the boundaries of the wet floor area, with safety cones or other types of barricades, serves to warn pedestrians, but does not aid in fixing the hazard, and the wet floor simply has to air dry.

U.S. Patent Application Publication No. 2003/0115783 discloses a combined floor dryer and caution sign in which a power driven fan unit is carried near a caster-supported base surface of a caution sign. The device is useful in that it provides the dual function of warning individuals of a wet floor area while at the same time facilitating the drying of that area. But the disclosed device suffers from significant design flaws. It teaches that the fan should only be directed to blow in one direction, more particularly, from one side of the sign. This limits the area that can be treated, and suggests that, in use, the sign is to be placed outside the boundaries of the wet area. This can increase the chances that an individual will walk into the wet area. Also, the air, directed as it is, will not necessarily blow across the ground surface for a significant distance. Similar design flaws are evident in U.S. Design Pat. No. D328,615.

Thus, there is a need in the art for a device that may be used in association with a safety cone, floor sign or barricade system that would aid in drying a wet floor. And there is a further need in the art that such a device be designed to treat a significant surface area, preferably permitting placement of the warning sign in the center of a wet area.

SUMMARY OF THE INVENTION

The present invention relates to "warning devices." As used herein, "warning devices" refers to any safety cone, floor core, floor sign or barricade or similar device that is commonly used for marking off the boundaries of a wet floor area.

The present invention provides a warning device having an air mover incorporated into its construction to aid in drying a wet floor in a 360° pattern around the warning device. These warning devices could be placed in the center of common safety cones that are placed around the boundaries of a wet floor area. Placement of the warning device directly over the wet area allows pedestrians to see the warning device before they are in harms way, allowing them sufficient time to avoid the hazard.

Although it is within the scope of the present invention to provide a warning device with a one-piece construction, for ease of manufacture, the warning devices are preferably made out of at least two pieces, a base dryer and a marker portion. The base dryer would take different forms for different types of warning devices, whether safety cones, floor cones, floor signs or other types of barricades. In some designs, the base dryer would include swivel casters for ease of transport. The base dryer includes the air mover for directing air at the wet floor on which it is placed. Although a fan is a preferred air mover, virtually any other means for blowing air over the wet floor may be employed, and heating elements may also be employed to dry the floor more efficiently by blowing warm air over its surface. The marker portion broadly provides the structure necessary to notify pedestrians of the wet floor hazard. As mentioned, the marker portion may either be integral with the base dryer or may be configured to fit thereon to provide a completed warning device. By way of non-limiting example, the marker portion may take the shape of a cone (safety cone, floor cone), sign or barricade.

The warning devices are preferably powered by cordless means, as the presence of a cord would present a new hazard at the very site where the warning device is to be used to warn pedestrians of the hazards of a wet floor. Virtually any means of power may be employed, including rechargeable batteries, solarcells, fuel cells, etc. Preferably, the power source would be a replaceable power source of the type that needs no tools for replacement. Thus, a spent power source could be replaced with a charged power source to reduce the time the warning device would be out of service.

Warning devices may be made with simple on/off switches or with on/off cycling self timers or both. The air movers might direct air at constant speeds or at variable speeds. For additional visual warning, the warning device could incorporate a flashing light on the top of the marker portion.

Inasmuch as the invention has been described as including a base dryer and marker portion, the warning devices could either be provided as complete units or a base dryer could be structurally designed to fit existing safety markers, i.e., safety cones, floor cones, floor signs and barricades and the like.

DESCRIPTION OF THE DRAWINGS

For a complete understanding of the objects, techniques and structure of the invention reference should be made to the following detailed description and accompanying drawings wherein.

PREFERRED EMBODIMENT FOR CARRYING OUT THE INVENTION

In light of the general understanding of the various elements of warning devices according to this invention, as already adequately described to those of skill in the art in the summary of invention section above, a most preferred embodiment of the present invention is now disclosed, with the understanding that the multitude of variations of warning devices that may be created in accordance with this invention may be practiced by those of ordinary skill in the art without undue experimentation.

Figure 1:
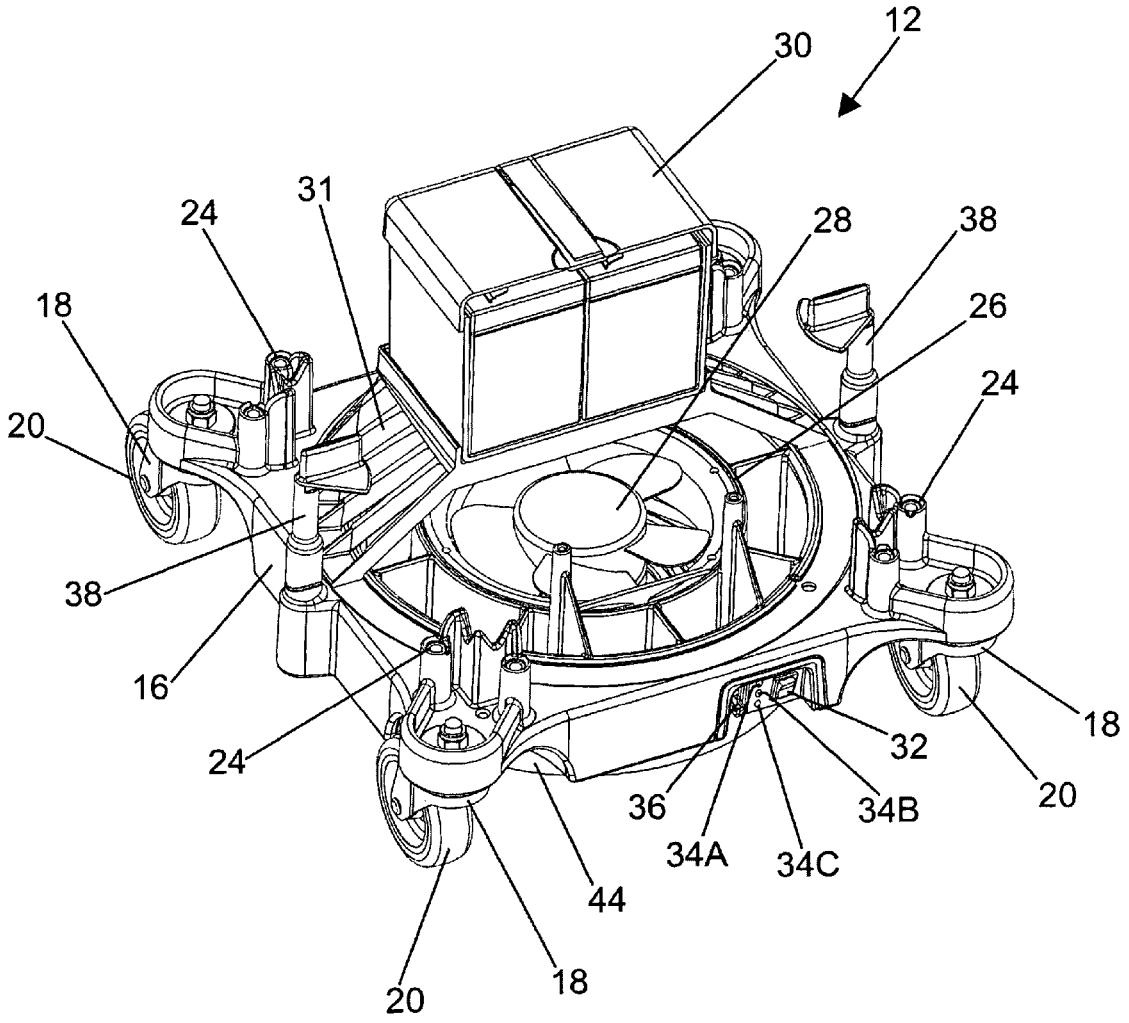
FIG. 1 is an elevated perspective view of a base dryer of a warning device in accordance with this invention with a portion removed for viewing certain elements thereof.
Figure 2:
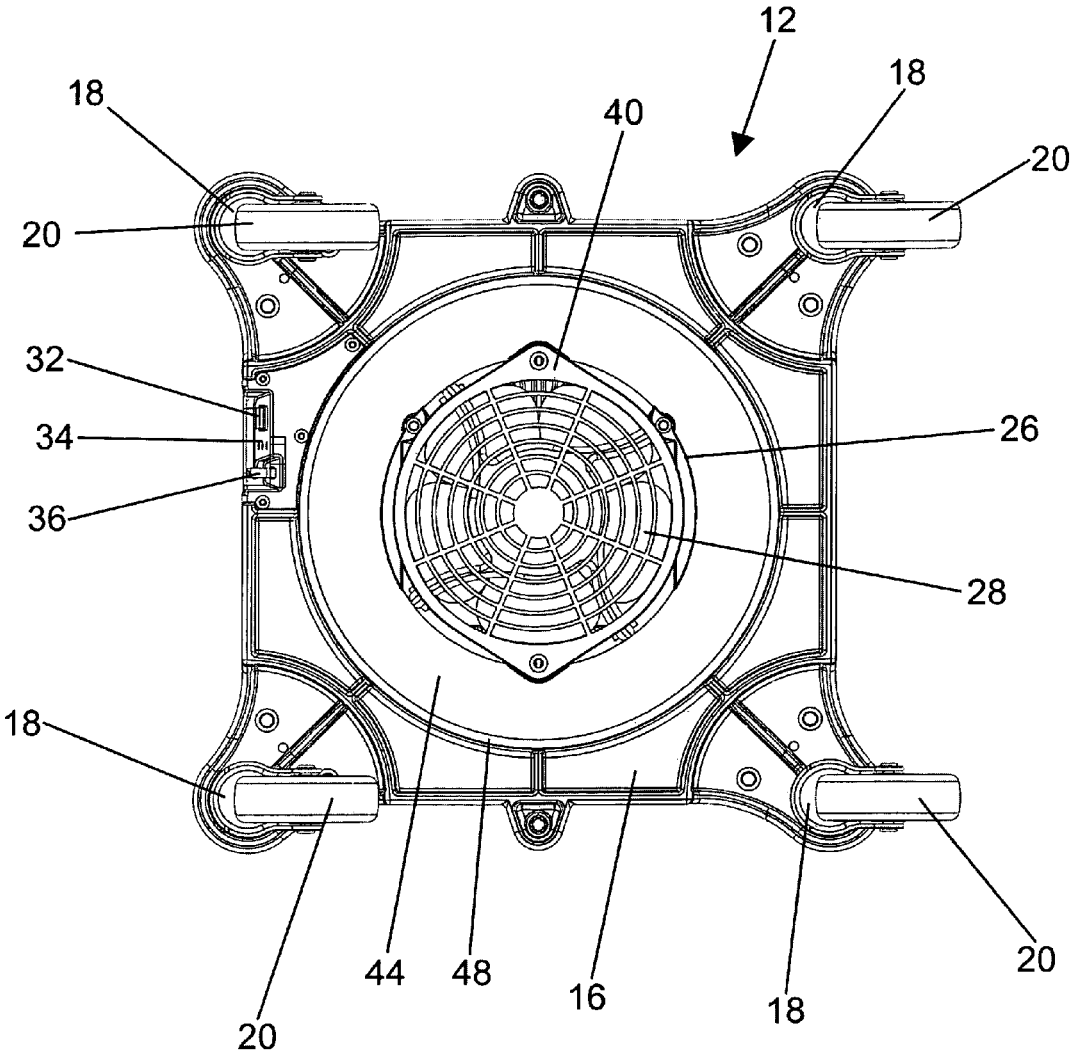
FIG. 2 is a bottom plan view of the underside of the base dryer of FIG. 1.
Figure 3:
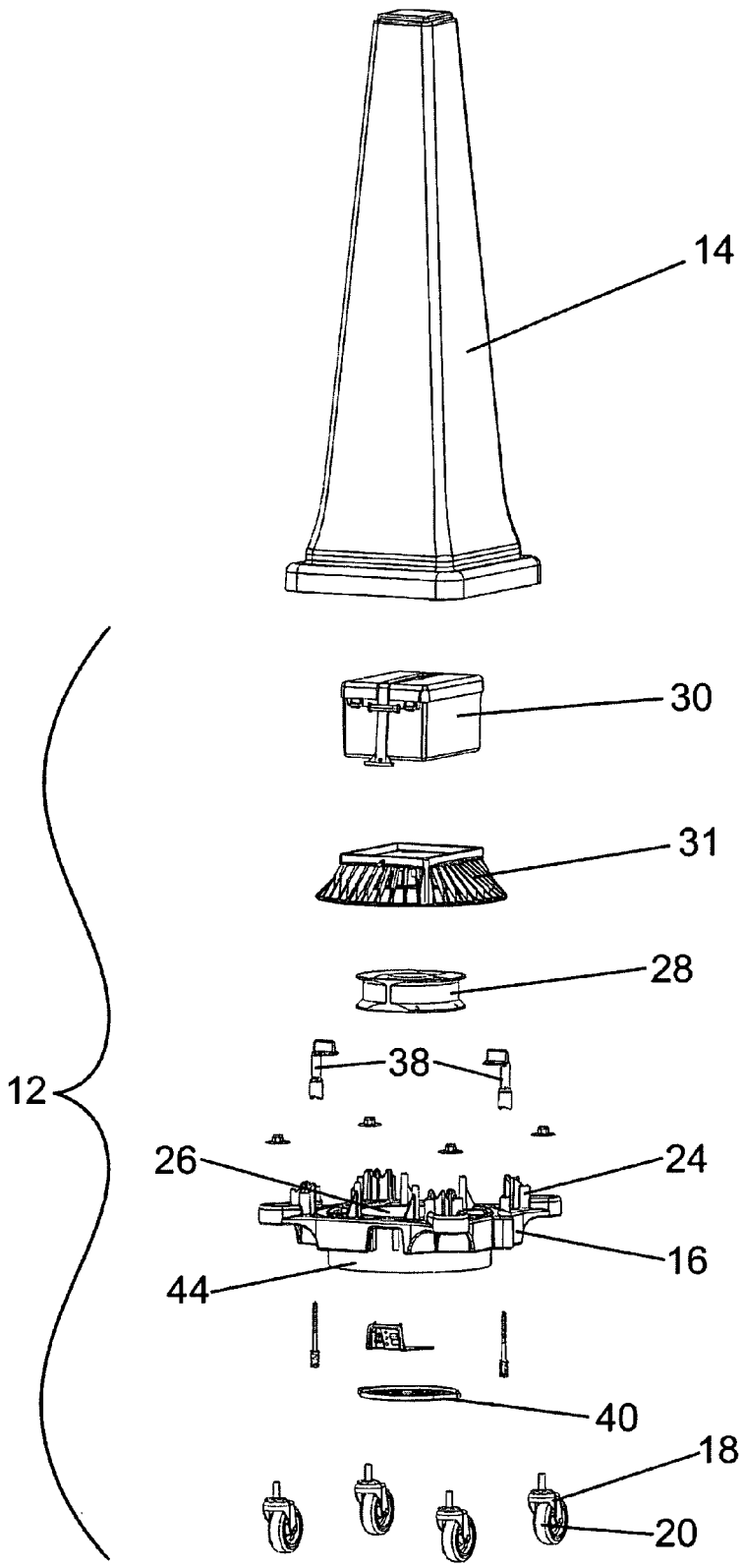
FIG. 3 is an assembly diagram showing the construction of the base dryer of FIGS. 1 and 2, and the fitting of the base dryer with a marker portion, particularly, a floor cone.
Figure 4:
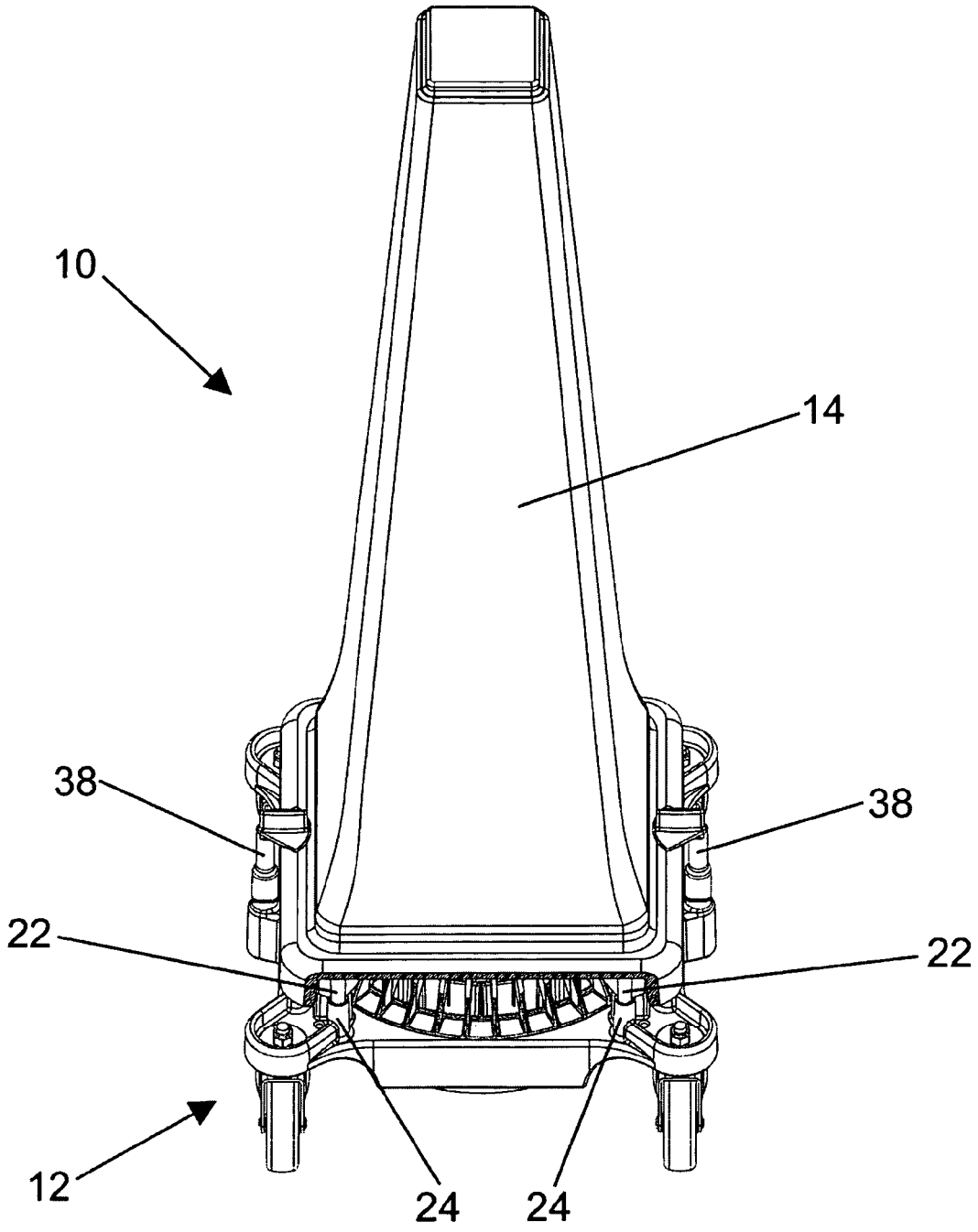
FIG. 4 is a perspective view of the assembled warning device of FIG. 3, with a portion of the cone/marker portion removed to show the joinder at male and female members.
Figure 5:
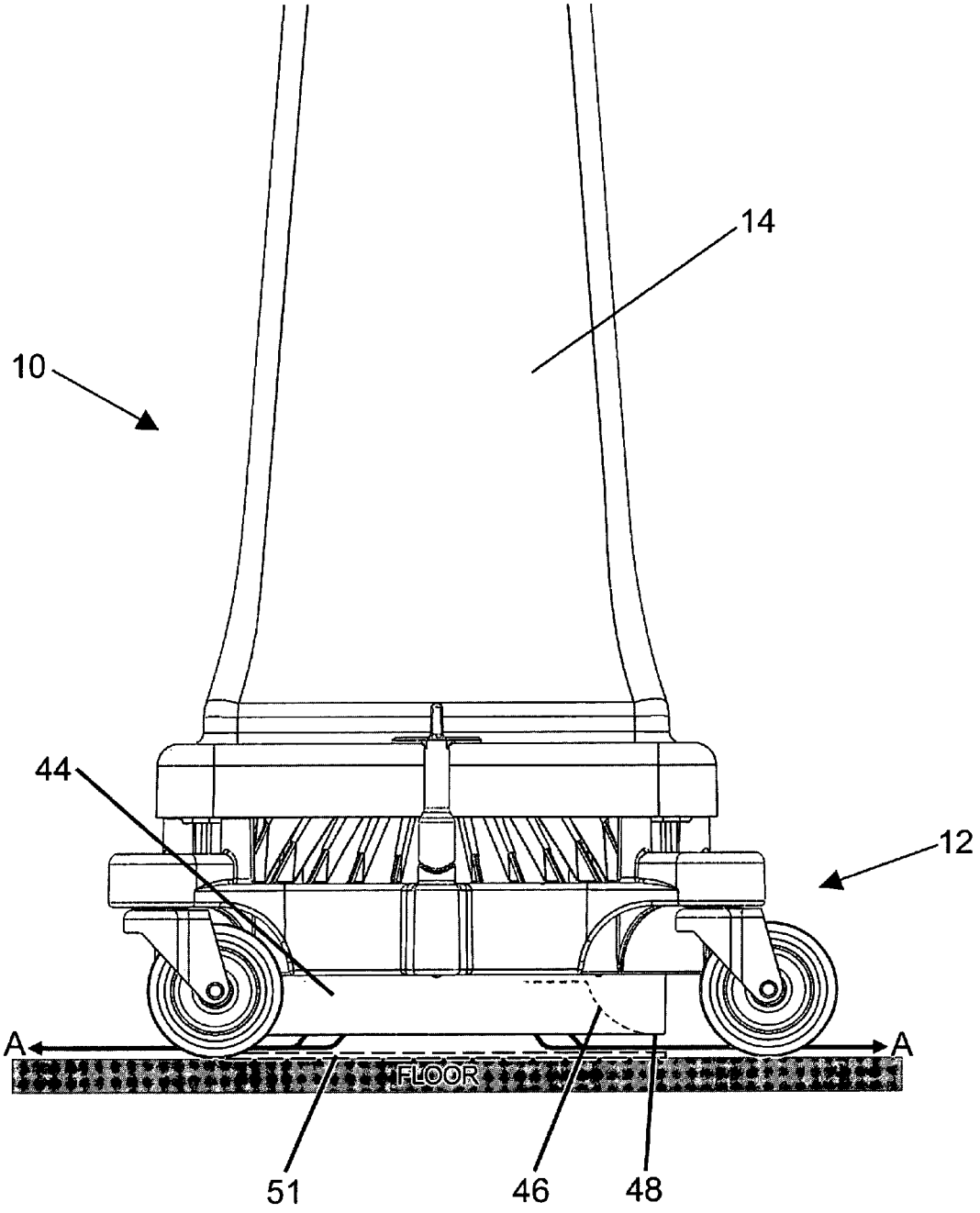
FIG. 5 is a side view of the assembled warning device of FIG. 3.

Referring now to FIGS. 1-5, a warning device according to this invention is shown and designated generally by the numeral 10 (a warning device is shown fully assembled in FIGS. 4 and 5). Warning device 10 includes base dryer 12 (FIGS. 1 and 2) and marker portion 14. Although base dryer 12 takes the form of a square base platform 16 supported at its corners by casters 18 and wheels 20, it will be appreciated that base dryer 12 may take many forms in accordance with the particular marker portion 14 with which it is to be employed, and may optionally be freestanding, without casters 18 and wheels 20. Similarly, as already indicated, marker portion 14, which here takes form of a floor cone, may take other forms, as, for example, the shape of a safety cone, floor sign or barricade or the like.

Regardless of the forms of the base dryer 12 and marker portion 14, when they are provided as separate units, they will preferably fit together through male members 22 and female members 24, as seen in FIG. 4 at the cut-away portion of marker portion 14. The male members are provided on the marker portion in the embodiment shown. In particularly preferred embodiments, such as the one shown, the female members 24 are provided at specific positions to accept the receipt of male members 22 on popular commercially available cone-type markers. The male and female members are shown here as dual bores 24 and rods 22, but they may take other forms. Here, the bores 24 are positioned to receive rods 22 provided on popular Newell Rubbermad Inc. cones so that retrofitting is possible. Another design for male and female members is exemplified by the W-shaped supports (female member), which is a "W" in both side and top views, and complimentary shaped projections (male members) on the base of a sign, such as that provided on cones from Allsafe Services and Materials (previously American Allsafe Company). Optionally, auxiliary connectors may be employed as, for example, connectors 38, which pivot to extend over marker portion 14 to prevent its removal from base dryer 12. Other means for connecting the two units may also be employed.

Base dryer 12 includes an aperture 26 that receives an air mover 28. Air mover 28 preferably includes a cordless power source 30, which, more preferably, is replaceable without tools and is rechargeable. In the embodiment shown, power source 30 is secured on top of guard 31, provided to prevent easy access to air mover 28. Access to air mover 28 is also preferably prevented by bottom guard 40 (FIGS. 2 and 3) as well. An on/off switch 32 (FIG. 2) appropriately communicates with power source 30 so that air mover 28 may be selectively activated to direct air at the floor.

It will be appreciated that air directed downwardly toward a floor surface will tend to flow in many directions and create various air currents, many of which are not in close proximity to the floor surface, and thus are non productive for drying a wet floor surface. Some of the air will simply bounce off of the floor and create upwardly flowing air currents, and will not be useful in drying the floor. Thus, this invention provides an air director to utilize the air flow more efficiently.

To focus the air in desired directions, air director 44 extends downwardly from the circumference of aperture 26, coaxial with the air flow, and terminates in close proximity to the surface upon which wheels 20 rest, thus providing a gap between the terminal end of air director 44 and the underlying surface. As seen in FIG. 5, at arrows A, air director 44 limits the randomness of the air currents produced by air mover 28, in that pressure builds withing the air director, forcing air out between air director 44 and the underlying surface, ensuring that air is directed to flow over, and stay in close proximity to, a wet surface area. The underlying surface is preferably the ground surface, but as an alternative, a plate 51 could be employed, as shown in phantom in FIG. 5. In either case, the air forced through air director 44 hits the underlying surface and, from there, is forced out between the ground surface and the terminal edge of air director 44 to spread out over the wet surface. The inner surface 46 of air director 44 is preferably arcuate, as seen in FIG. 5, as it was found that this design contributes to forcing the air out in a manner that keeps the air in close proximity to the wet ground surface for significant distances. In some embodiments, the arc to inner surface 46 is a circular arc, while, in others, the arc is made to flatten out proximate the terminal edge 48 thereof. Because air director 44 is circular in cross section, the air forced therethrough expands outwardly over the floor in a 360° pattern.

It has been found that the air director design, in which the air flow directed toward the ground surface (or plate) is bounded and restricted by the air director and the gap between the ground surface (or plate), serves to create an axisymmetric stagnation flow. Under the device, within the radial boundaries of the air director, exists a turbulent boundary layer of constant thickness. As the air is forced out between the gap created by the air director, an axisymmetric turbulent wall jet is created, and this wall jet spreads out in all directions (i.e., radially), with the height of the jet increasing roughly linearly as it travels radially further away from the air director, due to the entrainment of dry air from above the more moist air near the wet floor surface. The turbulent mixing is further enhanced by the tendency for the lighter moist air to rise and the tendency of the heavier dry air above to fall.

In accordance with an embodiment of this invention, the gap height between the bottom of air director 44 and the ground surface (or the optional plate 51 just described) is from 2 to 25 mm, more preferably from 5 to 20 mm. In a specific embodiment reduced to practice, the gap height is 12.7 mm. With such a range of gap heights, the air flow rate effected by air mover 28 preferably ranges from about 15 cubic feet per minute (cfm) to about 500 cfm, more preferably from 25 cfm to 400 cfm. In the embodiment having a gap height of 12.7 mm, the flow rate is chosen to be 228 cfm. This has been found to achieve the desired axisymmetric stagnation flow. It will be appreciated, however, that different gap heights could be practiced with different flow rates to achieve the same desired resultant flow.

Figure 6:
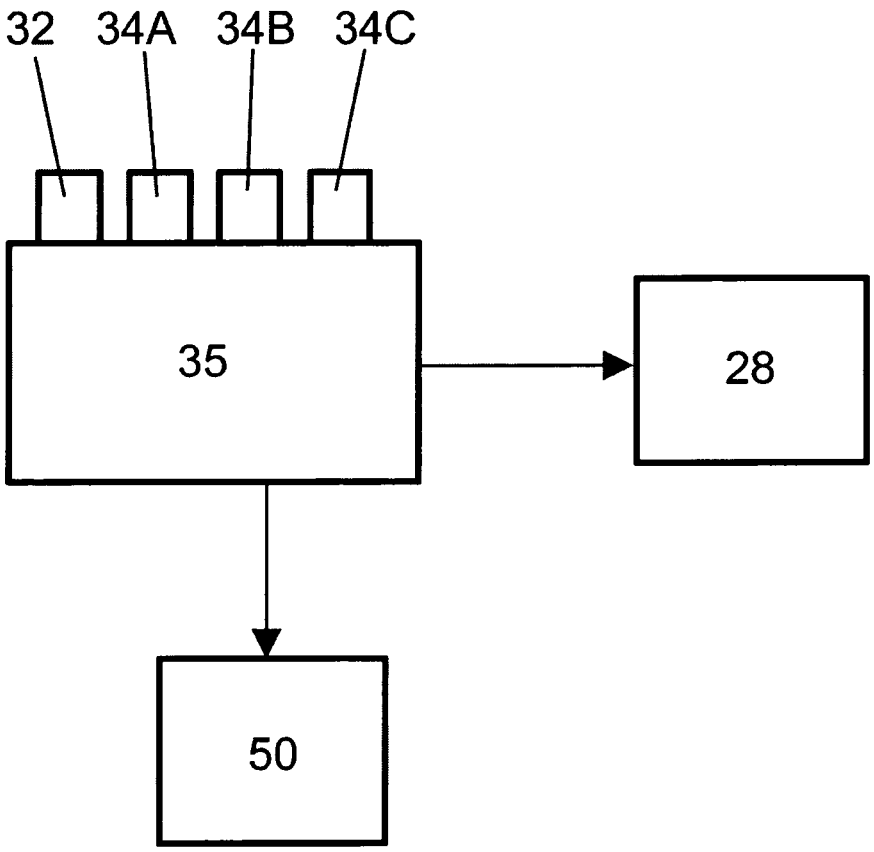
FIG. 6 is a schematic view that generally depicts the controlling of the dryer operation through appropriate buttons and a microprocessor.

As shown in FIG. 6, warning device 10 may also include a microprocessor 35 or similar control for controlling the timing at which the air mover 28 is activated and/or the airflow rate or other variables. Such a microprocessor could also control an optional heating element 50 to heat the air moved by the air mover 28. Thus, in FIG. 6, it is shown that on/off switch 32 and multiple buttons 34A, 34B and 34C, through macroprocessor 35. Control fan 28 and an optional heating element 50. By way of example, button 34A could control fan speed, button 34B the amount of time the fan stays on, and button 34C the degree of heat, if any, supplied by heating element 50. A charging jack 36 (FIG. 1) could be provided to allow for recharging of the battery while still received in the base.

Thus it can be seen that the present invention provides an improved warning device for use on a wet floor. While in accordance with the patent statutes only the best mode and preferred embodiments of the invention have been presented and described in detail, the invention is not limited thereto or thereby. Accordingly, for an appreciation of the true scope and breadth of the invention, reference should be made to the following claims.

The invention claimed is:

1. A floor dryer warning device comprising:

a base dryer portion configured for resting above an underlying surface;

an air director;

a marker portion to warn passers by;

an air mover operable to force air through said air director, wherein said air director includes at least one wall extending downwardly from an aperture that receives said air mover to define an air flow path and provides a terminal edge that flattens out to terminate above the underlying surface, said air forced through said air director is radially confined by said at least one wall such that exits said air director over and proximate to said underlying surface between said underlying surface and said terminal edge of said air director.

2. The warning device of claim 1, wherein said marker portion is removably attached to said base dryer.

3. The warning device of claim 2, wherein said marker portion extends upwards from said base dryer.

4. The warning device of claim 3, wherein said air mover is a fan.

5. The warning device of claim 3, further comprising a heating element that heats air forced to flow by said air mover.

6. A floor dryer comprising:

a base supported above an underlying surface;

an air mover retained by said base and operable to direct air at a flow rate toward the underlying surface;

an air director having at least one wall extending downwardly from an aperture that receives said air mover toward the underlying surface and having an arcuate inner surface terminating at a terminal edge, wherein said air director radially confines the air directed toward the underlying surface by said air mover, forcing the air to exit radially between the underlying surface and said terminal edge of said air director.

7. The floor dryer of claim 1, wherein said terminal edge of said air director terminates above the underlying surface at a distance of from 2 to 25 millimeters.

* * * * *